US009691561B2

(12) United States Patent
West

(10) Patent No.: US 9,691,561 B2
(45) Date of Patent: Jun. 27, 2017

(54) KNIFE SWITCH ASSEMBLY, AN ELECTRIC POWER DISTRIBUTION SWITCHGEAR AND A METHOD FOR PREVENTING ELECTRIC DISCHARGES

(71) Applicant: ABB Schweiz AG, Baden (CH)

(72) Inventor: John West, Skien (NO)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/128,889

(22) PCT Filed: Mar. 18, 2015

(86) PCT No.: PCT/EP2015/055696

§ 371 (c)(1),
(2) Date: Sep. 23, 2016

(87) PCT Pub. No.: WO2015/154957

PCT Pub. Date: Oct. 15, 2015

(65) Prior Publication Data

US 2017/0110263 A1 Apr. 20, 2017

(30) Foreign Application Priority Data

Apr. 9, 2014 (EP) ..... 14163976

(51) Int. Cl.
*H01H 1/42* (2006.01)
*H01H 21/56* (2006.01)
*H01H 31/00* (2006.01)

(52) U.S. Cl.
CPC ..... *H01H 1/42* (2013.01); *H01H 21/56* (2013.01); *H01H 31/003* (2013.01); *H01H 2001/425* (2013.01)

(58) Field of Classification Search
CPC ..... H01H 1/42; H01H 21/56; H01H 31/003; H01H 31/30
(Continued)

(56) References Cited

U.S. PATENT DOCUMENTS 2,009,815 A * 7/1935 Powers ..... H01H 31/02 200/15
2,200,509 A * 5/1940 Lindae ..... H01H 31/28 200/555
(Continued)

FOREIGN PATENT DOCUMENTS

CH 333686 A 10/1958
CN 201345301 Y 11/2009
(Continued)

OTHER PUBLICATIONS

European Search Report Application No. 14163976.5 Completed: Sep. 12, 2014;Mailing Date: Sep. 25, 2014 8 pages.
(Continued)

*Primary Examiner* — Truc Nguyen
*Assistant Examiner* — William Bolton
(74) *Attorney, Agent, or Firm* — Whitmyer IP Group LLC

(57) ABSTRACT

A knife switch assembly including a pair of hinged contact knives, arranged in parallel, and moveable between at least two positions. An operator device for moving the pair of contact knives between the at least two positions, and a guide member located between the two contact knives, having two projecting side parts, each projecting side part extending along at least part of a respective side of each contact knife, which side faces a corresponding side of the other contact knife.

10 Claims, 7 Drawing Sheets

(58) Field of Classification Search
USPC ..... 218/156, 37, 43; 200/15, 16 F, 48 KB, 200/254
See application file for complete search history.

(56) References Cited

U.S. PATENT DOCUMENTS

| | | | | |
|---|---|---|---|---|
| 2,872,659 | A | 2/1959 | Wills | |
| 3,427,419 | A | 2/1969 | Findley, Jr. | |
| 4,090,046 | A * | 5/1978 | Faust | H01H 27/06 200/15 |
| 4,139,747 | A * | 2/1979 | Kelly | H01H 33/02 200/48 KB |
| 5,403,983 | A * | 4/1995 | Luoma | H01H 9/36 218/1 |
| 6,362,444 | B1 | 3/2002 | Lee | |
| 6,838,627 | B1 * | 1/2005 | Isberg | H01R 13/03 200/262 |
| 8,263,890 | B2 | 9/2012 | Fujita et al. | |
| 2011/0095853 | A1 | 4/2011 | Connell | |

FOREIGN PATENT DOCUMENTS

| | | | |
|---|---|---|---|
| CN | 201780923 | U | 3/2011 |
| CN | 103198960 | A | 7/2013 |
| DE | 1199360 | B | 8/1965 |
| EP | 2613161 | A1 | 7/2013 |
| EP | 2930729 | A1 | 10/2015 |
| FR | 2048151 | A5 | 3/1971 |
| FR | 2170801 | A1 | 9/1973 |
| GB | 991294 | A | 5/1965 |

OTHER PUBLICATIONS

International Search Report and Written Opinion of the International Searching Authority Application No. PCT/EP2015.055696 Completed: May 19, 2016;Mailing Date: Jun. 8, 2015 11 pages.

* cited by examiner

KNIFE SWITCH ASSEMBLY, AN ELECTRIC POWER DISTRIBUTION SWITCHGEAR AND A METHOD FOR PREVENTING ELECTRIC DISCHARGES

TECHNICAL FIELD

The present disclosure relates to a knife switch assembly comprising a pair of hinged contact knives movable between at least two positions, and further comprising a first contact element and an operator device for moving the contact knifes between the at least two positions, of which one position is a position in which the contact knifes are in electric contact with the first contact element. The disclosure further relates to an electric power distribution switchgear comprising a three-phase module that comprises a knife switch assembly. The disclosure also relates to a method for preventing electric discharges or flash overs in a switching device for electric power distribution switchgear.

BACKGROUND

A switchgear is basically a circuit breaker or a general purpose switch of a larger scale, having the function of making it possible to cut off the current to a certain cable in large power networks and in industries. Such a switchgear comprises a circuit breaker and typically also a disconnecting switch or a general purpose switch. The entire switchgear is usually connected to ground, as a security measure.

Switchgears are used in electric power systems, with the purpose to control, protect and isolate electric equipment. In distribution nets, switchgears are located both on the high voltage side and the low voltage side of power transformers. The switchgear on the low voltage side of the transformers may be located in a building, with medium voltages breakers for distribution to end users by means of several individual circuits.

As mentioned, one of the basic functions of switchgears is protection, which includes interruption of short-circuits and overload fault currents while maintaining service to other unaffected distribution circuits in the net. An arc suppressor/eliminator is often provided in the switchgear in order to decrease or, preferably, eliminate any damages that may be caused by faults. An arc suppressor may short out an electric arc within a switchgear, and in doing so it may also prompt a breaker, located up-stream in the net, to clear the fault by cutting the power to the switchgear. Such an arc suppressor may comprise a knife switch, having a pivoting contact knife that is movable in order to connect the current carrying conductor to ground. Such an arc suppressor may also be called an earthing switch.

Switchgears used today in electric power distribution systems for medium and/or high voltages, e.g. 1-1000 kV, such as 12, 24 or 36 kV, are usually gas insulated switchgears (GIS) where the used insulating fluid is Sulphur hexafluoride (SF6). The switchgear is located in a sealed encapsulation, filled with the insulating fluid. In case of an internal arc in the switchgear, hot gasses resulting from vaporization of conductors, insulation and enclosure will flow from the arc area to the surroundings. These gases will increase the pressure inside the encapsulation that will eventually result in a blowout. In order to prevent the buildup of too much pressure, an arc suppressor can be introduced to minimize the arcing time. This arc suppressor may be of the knife switch type. The challenge in obtaining a successful use of arc suppressors is to ensure fast and adequate contact between the arc suppressor, i.e. the contact knives, and the conductors carrying the arc fault current. If the contact is not fast and adequate enough, this may cause a flash-over.

Today the solution is to add a non-conductive guide member, e.g. of plastic, on the current carrying conductor, where the contact knives are intended to come into contact with the conductor. The function of this guide member is to guide the knives to ensure fast and adequate contact (large enough contact area) between the knives and the conductor. The knives must make contact with the conductor at the right place, not too early and not too late, in order to have large enough contact area. However, this arrangement has the disadvantage that triple points may occur where the guide member is located on the current carrying conductor, due to a potentially very high electric field strength where a non-conductive material such as plastic is close to metal. This may result in starting partial discharges or electric flash-overs. Another disadvantage is that the guide member absorbs some of the kinetic energy from the contact knives when the moving contact knives hit the guide member, and then the contact knives are pressed apart before they can pinch onto the conductor. This may result in too early pinching of the contact knives onto the conductor. The contact knives will weld immediately to the conductor resulting in a too small contact area.

SUMMARY

An object of the present disclosure is to provide an improved knife switch that deals with some of the mentioned disadvantages.

According to the present invention is defined a knife switch assembly comprising a pair of hinged contact knives, arranged parallel to each other and connected to each other at a first respective end, and moveable between at least two positions, and a first electric contact element comprising a current carrying conductor, said contact knives being made of an electrically conductive material and being electrically connected at said first end to a first electric conductor, and further comprising an operator device for moving said pair of contact knives between the at least two positions, of which a first position is an open position in which a second respective end of the contact knives is disconnected from any electrical contact, and a second position is a first contact position in which said second respective end of the contact knives is in electrical contact with the first electric contact element, characterized in that it comprises a guide member located between the two contact knives, said guide member having two projecting side parts, each projecting side part extending along at least part of a respective side of each contact knife, which side faces a corresponding side of the other contact knife, and that said guide member is made of a non-conductive material and has a shape adapted to receive the first electric contact element between the two projecting side parts.

By having a guide member of non-conductive material between the two contact knives instead of having the guide member on the current carrying conductor as in prior art, corresponding to the first contact element, is obtained the advantage that the risk of having triple points on the current carrying parts is avoided. The guide member has the function of guiding the contact knives for proper contact with the first electric contact element and its current carrying conductor.

The guide member may e.g. be made of plastic, a polymer or similar.

According to another feature, the guide member may be configured to press the two contact knives apart when inserted between the two contact knives. This provides the advantage that the contact knives are pre-charged. This has the result that the contact knives do not have to be pushed apart upon contact with the current carrying conductor of the first electric contact element, since they are already slightly pushed apart by the guide member. Thus there is no loss of kinetic energy. When the contact knives are moved towards the first electric contact element comprising a current carrying conductor, they will not immediately pinch onto the contact element as soon as they come into the vicinity of the contact element. Instead the pinching onto the electric contact element will be slightly delayed until a larger inner surface of the respective contact knife is close to the contact element and then the electric field force will be high enough for the contact knives to pinch onto the contact element resulting in electric contact between the first electric contact element and the contact knives. This will ensure the moving contact knives do not come into contact with the first contact element and its current carrying conductor until the intended travel of the contact knives is completed and an adequate electric contact may be obtained.

According to another feature, the guide member may be detachably inserted between the two contact knives and be configured to fall off when the respective second end of the contact knives enters into contact with the first electric contact element during movement of the contact knives from an open position to the first contact position, in which first contact position the respective second end of the contact knives is in electrical contact with the first electric contact element. This will provide for an immediate contact between the contact knives and the first contact element as soon as the guide member has been disposed of in the contact moment.

Alternatively, the guide member may be provided with at least one stop member configured to stop the movement of the contact knives, from the open position to the first contact position, when the contact knives are in a correct position for contact with the first electric contact element. A guide member with a stop member is preferably not detachable. It may be configured to make sure that the angle between the contact knives and the first electric contact element is optimal to ensure adequate contact and to ensure that the movement of the contact knives stops in a correct position in relation to the first contact element.

According to another feature, the first electric conductor, to which the respective first end of the contact knives is electrically connected, may be connected to ground. Through this, a connection to ground is achieved for the first electric contact element and its current carrying conductor, and electric arcs and flashovers may be prevented.

According to another aspect of the invention is defined an electric power distribution switchgear comprising a sealed encapsulation inside which is located at least one three-phase module, the at least one three-phase module comprising a knife switch assembly as defined in any one of the claims above defining a knife switch assembly, one for each phase, and at least one current carrying conductor, one for each phase, forming the first electric contact element of the knife switch assembly. In addition to the already mentioned advantages above, this has the advantage that the function of an arc suppressor switch or earthing switch may be provided by means of said knife switch assembly.

Further, the sealed encapsulation may be filled with an insulation medium or a mixture of insulation medias. Examples of possible medias are any type of gas, such as nitrogen, carbondioxide, sulfurhexaflouride (SF6), air, dry air. The encapsulation should then be gas tight. As an alternative, there may be vacuum in the encapsulation. As another alternative, the medium may be a non-gas medium, e.g. oil.

Accordingly, the sealed encapsulation may be filled with a gas that is dry air, or a gas that comprises air mixed with another gas.

According to yet another aspect of the invention is defined a method for preventing electric discharges or electric arc flash overs in a switching device for electric power distribution switchgear, comprising providing a knife switch assembly with a guide member located between two contact knives of the knife switch assembly, which guide member is made of a non-conductive material. The guide member should be configured to receive an electric contact element, comprising a current carrying conductor, between two projecting parts thereof.

Further, the method may comprise pre-charging the two contact knives of the knife switch assembly by pressing the contact knives apart by means of the guide member.

In addition, the method may comprise adjusting a width of the guide member in order to define the pre-charging in relation to an arc contact force, which width is an external width of the guide member located between the contact knives.

The method may also comprise adjusting a height of projecting side parts of the guide member in order to define where the contact knives will make contact with the first electric contact element.

The knife switch assembly and the switchgear of the present disclosure is e.g. suitable for use in electric power distribution systems arranged as a ring, and comprising a number of gas-insulated switchgear (GIS) installations connected in the ring.

Further features and advantages of the invention will also become apparent from the following detailed description of embodiments.

BRIEF DESCRIPTION OF THE DRAWINGS

A detailed description of the present invention and embodiments thereof, given as examples only, will now be made with reference to the accompanying schematic drawings, in which.

DETAILED DESCRIPTION

Figure 1:
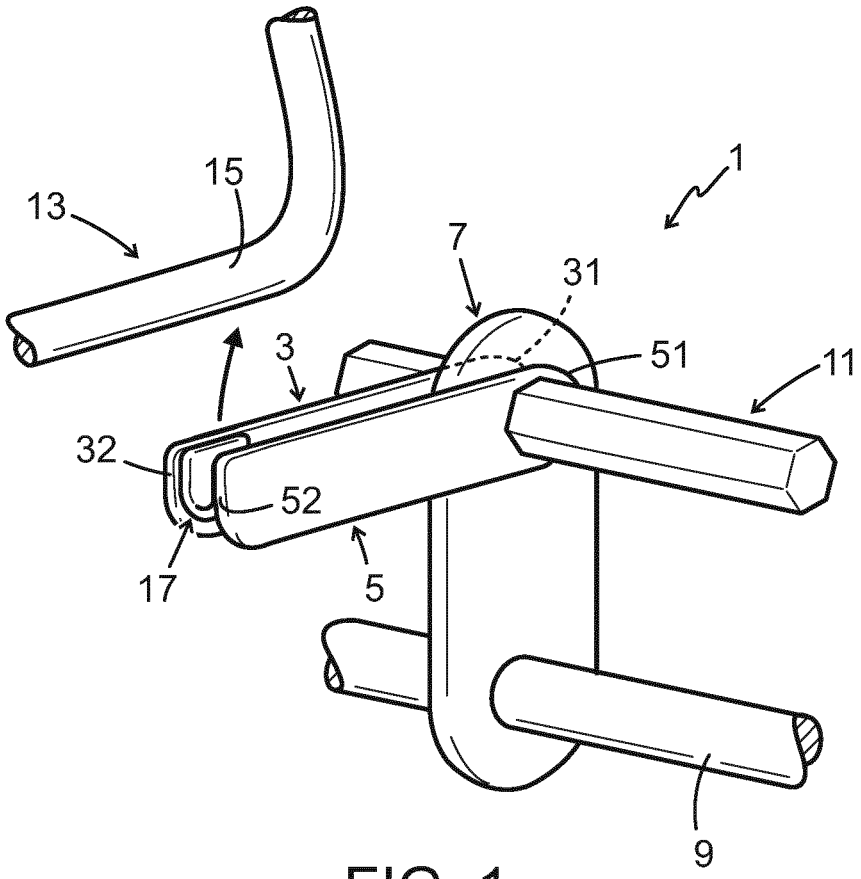
FIG. 1 shows a schematic perspective view of an embodiment of a knife switch assembly according to the present invention, in its open position.
Figure 2:
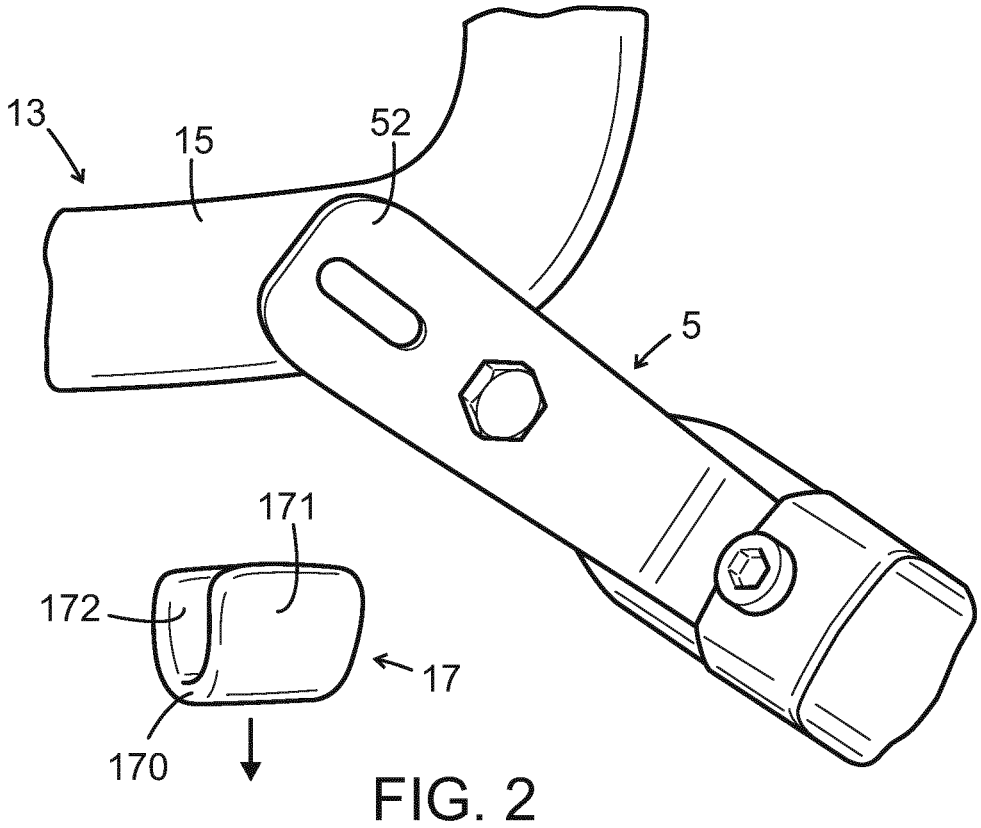
FIG. 2 shows an enlarged partial side view of the embodiment of a knife switch assembly shown in FIG. 1, in its closed position.
Figure 3:
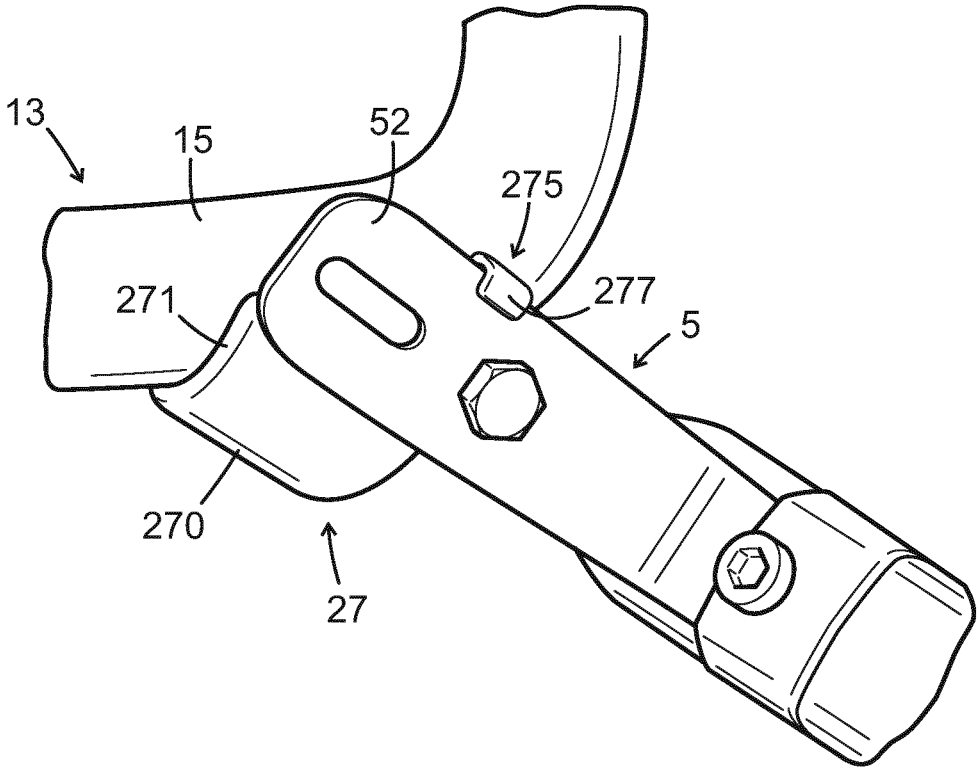
FIG. 3 shows an enlarged partial side view of another embodiment of a knife switch assembly according to the present invention, in its closed position.

In FIG. 1 is illustrated an embodiment of a knife switch assembly according to the present disclosure. The knife switch assembly 1 comprises a pair of hinged contact knives 3, 5 arranged in parallel to each other and at a distance from each other. Each contact knife 3, 5 has a first end 31, 51 and a second end 32, 52. The contact knives are connected at their respective first ends 31, 51 by a connection member 7. The contact knives are made of an electrically conductive material and their respective first ends 31, 51 are also connected to a first electric conductor 9, by means of said connection member 7, which is also made of an electrically conductive material. The first electric conductor 9 may for example be a current carrying conductor or it may be connected to ground. The contact knives 3, 5 are connected to the connection member 7 by means of a hinge device in order for the contact knives to be movable, i.e. pivotable, between at least two positions. The two contact knives are always moved together, parallel to each other. The knife switch assembly further comprises an operator device 11 for moving the hinged contact knives between the at least two positions. This operator device may be manually or automatically operated. The knife switch assembly also comprises a first contact element 13 comprising a current carrying conductor 15. In the illustrated example, the contact knives 3, 5 are movable between two positions, a first position that is an open position as illustrated in FIG. 1, and a second position that is a closed position in which the contact knives are in contact with the current carrying conductor 15 of the first contact element 13, as is illustrated in FIGS. 2 and 3. This is illustrated by the arrow in FIG. 1

Figure 4:
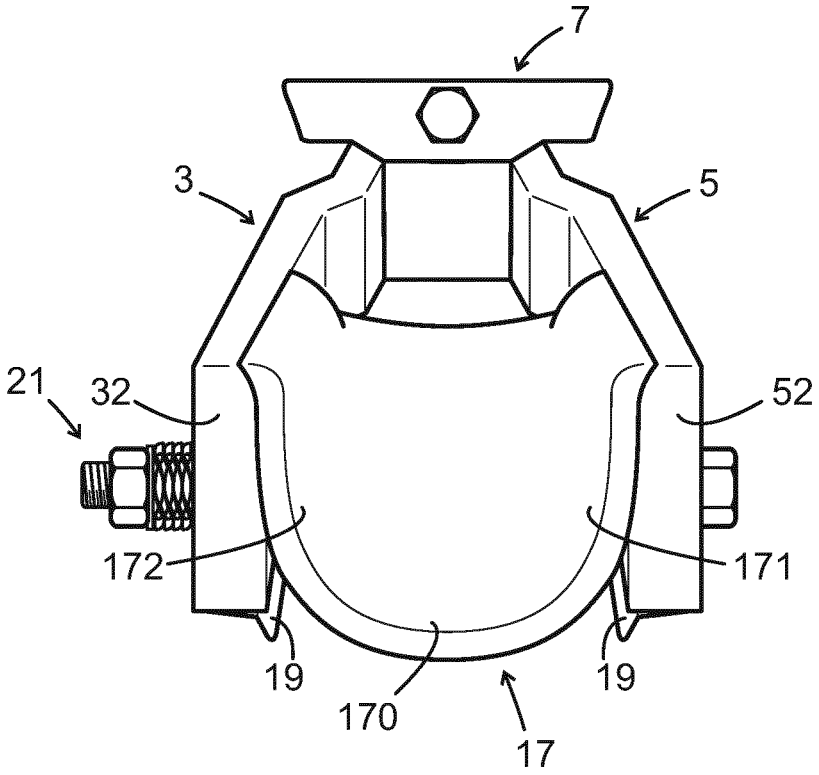
FIG. 4 is an enlarged partial front view of the knife switch assembly shown in FIGS. 1 and 2.

In the embodiment shown in FIG. 1 is also shown a guide member 17 according to a first embodiment. The guide member according to this first embodiment is also illustrated in FIGS. 2 and 4. The guide member is made of a non-conductive material, e.g. plastic. The guide member is located between the contact knives 3, 5, close to their respective free second ends 32, 52. The guide member is configured with a bottom part 170 from which two projecting side parts 171, 172 extend upwards. When the guide member is mounted between the contact knives, the projecting side parts extend along at least a part of the inside of each contact knife. The guide member is dimensioned such that it has an external width, in relation to the distance between the two contact knives, which is slightly larger than that distance. Due to this, the contact knives are pressed apart slightly by the guide member and thereby is obtained an effect of pre-charging of the contact knives. The width of the guide member may be chosen in relation to the amount of pre-charging that is desired in each case. As illustrated in FIG. 2, the guide member may have an approximate shape of a partial cylinder, having an open side. Its width may be slightly larger at its open side, which faces the first contact element. Its height may also be chosen depending on where it is desirable that the contact knives 3, 5 hit the current carrying conductor 15 of the first contact element 13, as will be explained later. The guide member may also be provided with attachment means 19, e.g. in the shape of hooks, that secure the guide member underneath the contact knives, e.g. by snapping. There may also be a spring device 21 arranged on the sides of the contact knives that acts to press the contact knives towards each other, and that provides a counter force to the guide member.

The guide member 17 according to the first embodiment, is configured to fall off from the contact knives when the contact knives hits the current carrying conductor 15, when they are moved from the first open position to the closed position by the operator device. This is illustrated in FIG. 2, by the arrow. When the ends 32, 52 of the pair of contact knives 3, 5 hit the current carrying conductor 15, the guide member falls off, and electric contact is made between the contact knives and the current carrying conductor. Thus an electric path is obtained between the current carrying conductor 15 of the first electric contact element 13 and the conductor 9. The conductor 9 may be connected to ground and thus the switch assembly functions as an earthing switch. Alternatively, the conductor 9 may not be connected to ground and thus the switch assembly functions as a short circuit between the phases, when used in a three-phase switchgear. In this case all three contact knives for the respective phases are connected to the same conductor 9 forming a short circuit jumper.

Figure 5:
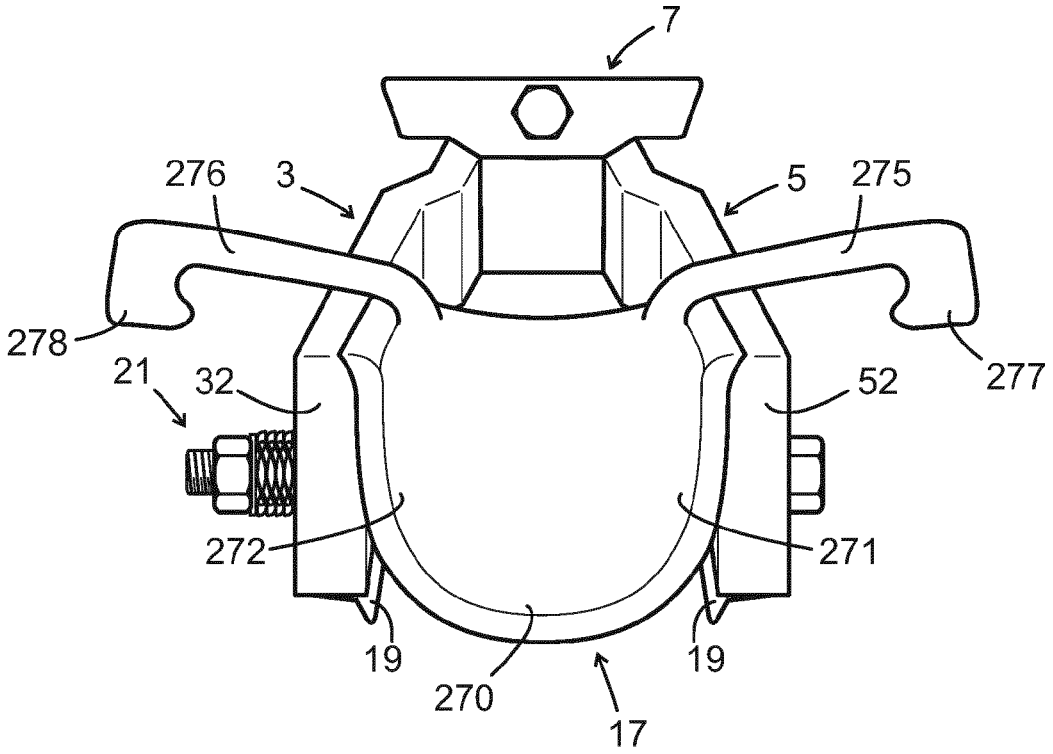
FIG. 5 is an enlarged partial front view of the knife switch assembly shown in FIG. 3.

In FIGS. 3 and 5 is schematically illustrated another embodiment of a guide member 27, according to the present invention. However, this guide member is not designed to fall off when the contact knives 3, 5 hit the current carrying conductor 15 of the first contact element 13. Instead, the guide member 27 has the additional function of stopping the movement of the contact knives 3, 5 in relation to the current carrying conductor 15, when the contact knives hit this conductor in a closing operation. The design of the guide member should be such that the contact knives should be stopped in a position that will result in an optimal contact between the current carrying conductor 15 and the contact knives 3, 5. Due to this, the guide member has a somewhat different design. The guide member 27 has a bottom part 270 and two projecting side parts 271, 272 similar to the previous embodiment of a guide member 17. In addition, at a rear part of the guide member 27, there is provided two stopper members 275, 276 that projects sideways from the projecting side parts 271, 272. When the guide member 27 is mounted between the contact knives 3, 5, the stopper members will extend sideways and over the respective upper edge of the contact knives and further away from the respective contact knife. When the contact knives 3, 5 hit the current carrying conductor 15, in a closing operation, the guide member 27 will be pressed down between the contact knives by sliding against the inside of the contact knives. The stopper members will then also move, first along the upper edge of the contact knives and then further along the inside of the contact knives until a hook part 277, 278 at the end of the respective stopper member engages over the upper edge of each contact knife and thereby stops further movement of the guide member. In FIG. 3 the final position of the guide member 27 and the stopper member 275 with its hook part 277 is illustrated. It can be seen that the guide member 27 has now been displaced downwards between the contact knives such that a large part of the inside of the contact knife 5 is no longer covered by the projecting side part 271 of the guide member. Instead the inside of the contact knife 5 is exposed for contact with the current carrying conductor 15.

Generally, the guide member 17, 27 should be designed with the objective that the pre-charging of the contact knives should be optimal and that the contact between contact knives 3, 5 and the current carrying conductor 15 should take place in an exact desired relative position, taking into consideration e.g. arc contact force and electric field forces. Consequently, the different measurements of the different parts of the guide member, e.g. the external width of the guide member, the height of the projecting side parts of the guide member, should be adapted to each particular case.

Figure 6:
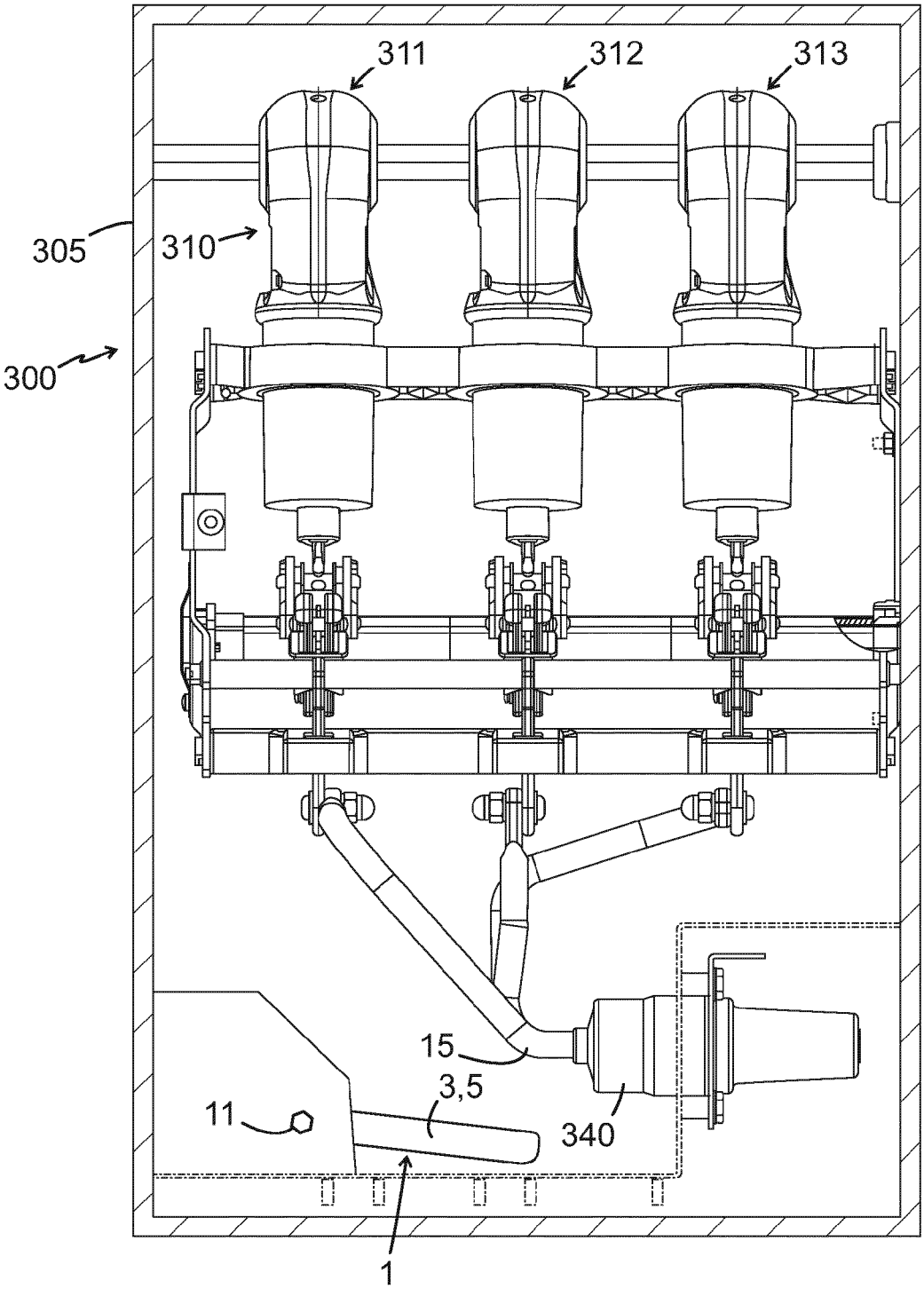
FIG. 6 is a schematic illustration of a switchgear comprising a knife switch assembly, in accordance with the present invention.

In FIG. 6 is shown an example of an application of the present invention in a switchgear 300 for a three phase AC electric power distribution system. The switchgear 300 comprises a sealed encapsulation 305 inside which three-phase modules are located, e.g. between one and up to five modules, or even more. The illustrated example is a switchgear comprising one module 310 comprising three poles/phases 311, 312, 313. Every phase is provided with a set of circuit breakers/load breakers.

Each one of the phases is connected to a first current carrying conductor 15 that enters the encapsulation 310 via an electric bushing 340. For each phase, a knife switch assembly 1 according to the present invention is arranged for connection or disconnection to the current carrying conductor 15 of that phase. In the schematic illustration of FIG. 6, only one knife switch assembly 1 has been shown. In FIG. 6 the knife switch assembly is shown in an open position. The knife switch assembly of the respective phase can be connected to ground, and it can be used to short-circuit and earth all the tree phases, or it can be used to short-circuit the three phases without connecting them to earth.

Figure 7:
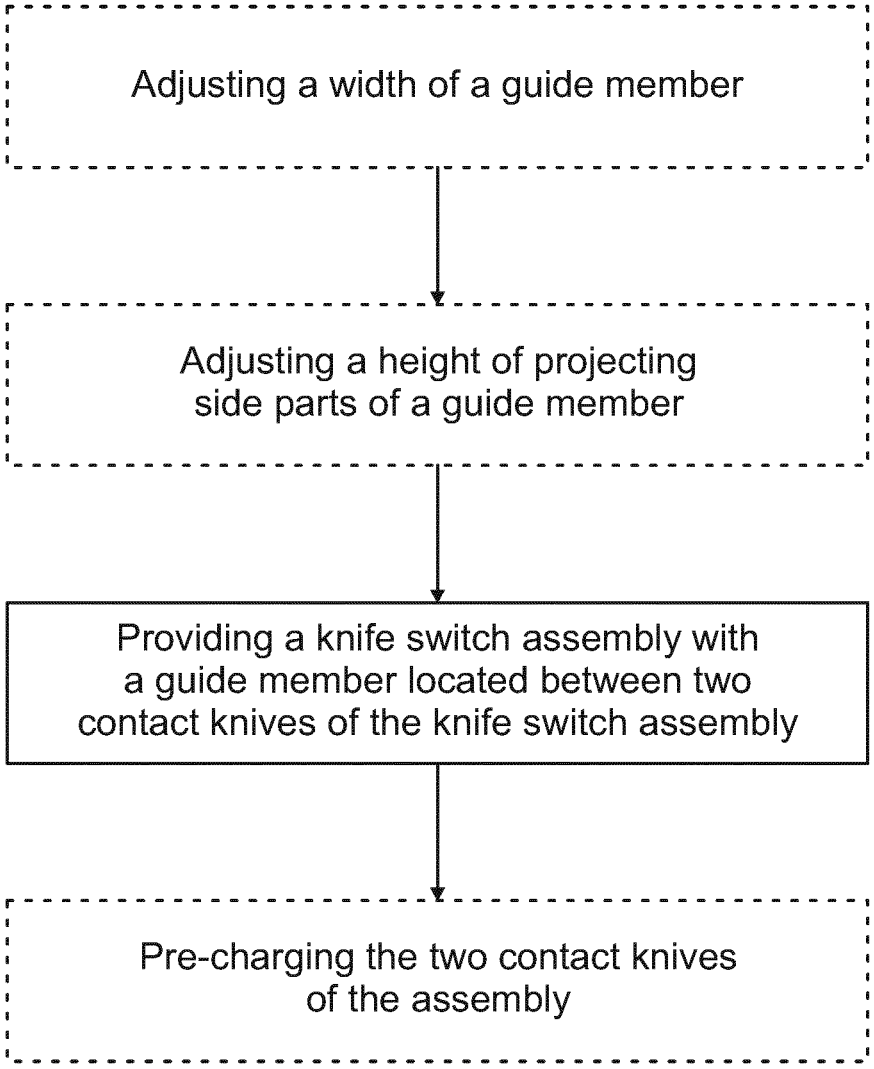
FIG. 7 is a diagram illustrating a method according to the present invention.

In FIG. 7 is shown a diagram illustrating a method preventing electric discharges or electric arc flash overs in a switching device for electric power distribution switchgear, according to the present invention. The method comprises the following steps:

Providing a knife switch assembly with a guide member located between two contact knives of the knife switch assembly, which guide member is made of a non-conductive material. The guide member should be configured to receive an electric contact element, comprising a current carrying conductor, between two projecting parts thereof;

Optionally, pre-charging the two contact knives of the knife switch assembly by pressing the contact knives apart by means of the guide member;

Optionally, adjusting a width of the guide member in order to define the pre-charging in relation to an arc contact force, which width is an external width of the guide member located between the contact knives;

Optionally, adjusting a height of projecting side parts of the guide member in order to define where the contact knives will make contact with the first electric contact element.

The invention shall not be considered limited to the illustrated embodiments, but can be modified and altered in many ways, as realised by a person skilled in the art, without departing from the scope defined in the appended claims. For example, the invention may be used for a three position knife switch instead of a two position knife switch.

The invention claimed is:

1. A knife switch assembly comprising a pair of hinged contact knives, arranged parallel to each other and connected to each other at a first respective end, and moveable between at least two positions, a first electric contact element comprising a current carrying conductor, said contact knives being made of an electrically conductive material and being electrically connected at said first end to a first electric conductor, an operator device for moving said pair of contact knives between the at least two positions, of which a first position is an open position in which a respective second end of the contact knives is disconnected from any electrical contact, and of which a second position is a first contact position in which said respective second end of the contact knives is in electrical contact with the first electric contact element and, a guide member located between the two contact knives, said guide member having two projecting side parts the, projecting side parts extending along at least part of respective sides of contact knives, wherein each side faces one another, and said guide member is made of a non-conductive material and has a shape adapted to receive the first electric contact element between the two projecting side parts.

2. The knife switch assembly according to claim 1, wherein the guide member is configured to press the two contact knives apart when inserted between the two contact knives.

3. The knife switch assembly according to claim 1, wherein the guide member is detachably inserted between the two contact knives and is configured to fall off when the respective second end of the contact knives enters into contact with the first electric contact element during movement of the contact knives from an open position to the first contact position, in which first contact position the respective second end of the contact knives is in electrical contact with the first electric contact element.

4. The knife switch assembly according to claim 1, wherein the guide member is provided with at least one stop member configured to stop the movement of the contact knives, from the open position to the first contact position, when the contact knives have entered into electric contact with the first electric contact element.

5. The knife switch assembly according to claim 1, wherein the first electric conductor, to which the respective first end of the contact knives is electrically connected, is connected to ground.

6. An electric power distribution switchgear, comprising a sealed encapsulation inside which is located at least one three-phase module, the at least one three-phase module comprising a knife switch assembly as defined in claim 1, one for each phase, and at least one current carrying conductor, one for each phase, forming the first electric contact element of the knife switch assembly.

7. The electric power distribution switchgear according to claim 6, wherein the knife switch assembly performs the function of an arc suppressor switch.

8. The electric power distribution switchgear according to claim 6, wherein the knife switch assembly performs the function of an earthing switch.

9. The electric power distribution switchgear according to claim 6, wherein the sealed encapsulation is filled with an insulation medium or a mixture of dielectric insulation medias.

10. The electric power distribution switchgear according to claim 6, wherein the sealed encapsulation is filled with a gas that is dry air, or a gas that comprises air mixed with another gas.

* * * * *